US010444775B2

(12) United States Patent
Romanov et al.

(10) Patent No.: US 10,444,775 B2
(45) Date of Patent: Oct. 15, 2019

(54) APPARATUS FOR PRODUCING UNVARYING DIRECT LOAD CURRENT

(71) Applicant: CLOSED-UP JOINT-STOCK COMPANY DRIVE, Novosibirsk (RU)

(72) Inventors: Yuriy I. Romanov, Novosibirsk (RU); Stanislav V. Maletskiy, Novosibirsk (RU)

(73) Assignee: Drive CJSC, Novosibirsk (RU)

( * ) Notice: Subject to any disclaimer, the term of this patent is extended or adjusted under 35 U.S.C. 154(b) by 0 days.

(21) Appl. No.: 15/310,445

(22) PCT Filed: May 12, 2014

(86) PCT No.: PCT/RU2014/000336

§ 371 (c)(1),
(2) Date: Nov. 11, 2016

(87) PCT Pub. No.: WO2015/174881

PCT Pub. Date: Nov. 19, 2015

(65) Prior Publication Data

US 2017/0083032 A1 Mar. 23, 2017

(51) Int. Cl.
*G05F 1/56* (2006.01)
*G05F 1/563* (2006.01)

(52) U.S. Cl.
CPC ..... *G05F 1/56* (2013.01); *G05F 1/563* (2013.01)

(58) Field of Classification Search
CPC ... G05F 1/10; G05F 1/46; G05F 1/461; G05F 1/462; G05F 1/56; G05F 1/563; G05F 1/565; G05F 1/575; G05F 1/59; G05F 1/595; H02M 3/00; H02M 3/02; H02M 3/04; H02M 3/10; H02M 3/145; H02M 3/155; H02M 3/156; H02M 3/158; H02M 3/1582; H02M 2003/1566; H02M 2001/0045; H02M 3/1588; H02M 3/33523; H05B 33/0812; H05B 33/0815; H05B 33/0809; Y02B 20/343; Y02B 20/345; Y02B 20/346; Y02B 20/347
USPC ..... 323/222–226, 266, 271–275, 280, 323/282–285, 311, 312, 351; 363/123, 363/124; 315/194–199, 185 R–193, 287,
(Continued)

(56) References Cited

U.S. PATENT DOCUMENTS 8,519,642 B2 * 8/2013 Ahn ..... H05B 33/0893 315/209 R
2010/0220049 A1 * 9/2010 Murakami ..... H05B 33/0815 345/102

(Continued)

*Primary Examiner* — Alex Torres-Rivera
*Assistant Examiner* — Carlos O Rivera-Perez
(74) *Attorney, Agent, or Firm* — Patentagar PLLC; Alexander Rabinovich

(57) ABSTRACT

An apparatus for producing unvarying direct load current comprises a DC voltage source, a direct-voltage-to-pulse-voltage converter (DCPVC), a pulse-voltage-to-direct voltage converter (PDCVC), a DC stabilizer, and a load connected by one of its terminals to an output of the PDCVC and by another terminal to an input of the DC stabilizer, and a control circuit connected by one of its inputs to one of the terminals of the load, by another input to an output of the direct current stabilizer, and by an output to a control input of the DCPVC. As the load varies, a stabilizing voltage at the DC stabilizer is formed, and a direct load current, unvarying in a wide range of load variations, is produced.

1 Claim, 3 Drawing Sheets

(58) Field of Classification Search
USPC ..... 315/291–295, 297, 299–301, 302, 307, 315/308
See application file for complete search history.

(56) References Cited

U.S. PATENT DOCUMENTS

| | | | | |
|---|---|---|---|---|
| 2011/0043133 | A1* | 2/2011 | Van Laanen | H02M 1/4225 315/294 |
| 2013/0009556 | A1* | 1/2013 | Szczeszynski | H03K 7/08 315/185 R |
| 2014/0247523 | A1* | 9/2014 | Kawano | H02H 9/02 361/18 |

* cited by examiner

APPARATUS FOR PRODUCING UNVARYING DIRECT LOAD CURRENT

CROSS-REFERENCE TO RELATED APPLICATIONS

This application is a U.S. National phase CIP application of International application PCT/RU2014/000336 (publication WO2015/174881) filed on May 14, 2014, the International application being hereby incorporated by reference in its entirety.

BACKGROUND OF THE INVENTION

1. Field of the Invention

The invention relates to electrical engineering and can be used in power supply systems providing an unvarying direct current flowing in a load circuit where the load can vary in a wide range.

2. Description of the Related Art

Known have been similar technical solutions, such as a linear voltage regulator with continuous-pulse regulation (SU1229742, publ. May 7, 1986), which comprises the following set of essential features:

- a DC voltage source;
- a DC voltage—pulse voltage converter (DCPVC) which is connected by its input to the output of the DC voltage source;
- a pulse voltage—DC voltage converter (PDCVC), its input being connected to the output of the DCPVC (DLC-filter);
- a linear voltage stabilizer connected by its input to the output of the PDCVC;
- a first voltage divider connected in parallel to the PDCVC;
- a second voltage divider connected between the output of the linear voltage stabilizer and the negative terminal of the DC voltage source;
- a load connected by one of its terminals to the output of the voltage linear stabilizer and by another terminal to the negative terminal of the DC voltage source;
- a control circuit connected by its first input to the output of the first voltage divider, by its second input to the output of the second voltage divider and by its output to a control input of the DCPVC.

Common features of the present invention and the above-characterized regulator are:

- the DC voltage source;
- the DCPVC connected by its input to the output of the DC voltage source;
- the PDCVC connected by its input to the output of the DCPVC;
- the linear voltage stabilizer;
- the load;
- the control circuit connected by its output to the control input of the DCPVC.

Also know in the art is a method of driving voltage-controlled devices or current-controlled devices (U.S. Pat. No. 7,583,068 published Sep. 1, 2009) disclosing apparatuses comprising:

- DC voltage supply;
- a DCPVC connected by its input to an output of the DC voltage source;
- a PDCVC connected by its input to an output of the DCPVC;
- a load connected by one of its terminals to an output of the PDCVC;

- a measuring resistance connected by one of its terminals to another terminal of the load and connected by another of its terminals to a case ground);
- a first and a second sources of a reference voltage;
- a selection unit connected by its first and second inputs to outputs of the first and second reference voltage sources, respectively;
- a control circuit connected by its first input to the other terminal of the load, by its second input to an output of the selection unit, and by its output to a control input of the DCPVC.

Common features of the present invention and the above-characterized apparatuses are:

- the DC voltage supply;
- the DCPVC connected by its input to the output of the DC voltage source;
- the PDCVC connected by its input to the output of the DCPVC;
- the load connected by one of its terminals to the output of the PDCVC;
- the control circuit connected by its input to the other terminal of the load, and by its output to the control input of the DCPVC.

An apparatus known from Dodik S. D. et al. "Semiconductor Power Supply", Moscow, 1969, pp. 191-192, FIG. 119*a*, comprises:

- a PDCVC;
- a load connected by one of its terminals to an output of the PDVC;
- a DC stabilizer connected by its input to another terminal of the load.

Common features of the present invention and the above-characterized apparatuses are:

- a PDCVC;
- a load connected by one of its terminals to an output of the PDVC;
- a DC stabilizer connected by its input to another terminal of the load.

Also known has been a device for producing direct current passing into load power-supply circuits (RU2012133772, publ. Feb. 20, 2014), which is selected as the closest analogue—the prototype and which contains the following set of essential features:

- a DC voltage supply;
- a DCPVC connected by its input to an output of the DC voltage source;
- a PDCVC connected by its input to an output of the DCPVC;
- DC stabilizer connected by its input to an output of the PDCVC;
- a control circuit connected by its first input to the output of the DCPVC, by its second input to a first output of the DC stabilizer, and by its output to a control input of the DCPVC;
- a load connected by one of its terminals to a second output of the DC stabilizer and by its another terminal to the negative terminal of the DC voltage source.

Common features of the present invention and the above-characterized device-prototype are:

- the DC voltage supply;
- the DCPVC connected by its input to the output of the DC voltage source;
- the PDCVC connected by its input to the output of the DCPVC;
- the DC stabilizer;
- the load;

the control circuit connected by one of its inputs to the first output of the DC stabilizer, and by its output to the control input of the DCPVC.

The technical result that cannot be achieved by any of the above-characterized analogous technical solutions is widening the range of load values.

The cause of the failure to achieve the above technical result is that issues related to the expansion of the range of values of the load resistance have not been given proper attention, since it was believed that the load range values already achieved easily meet the requirements of the present time.

Given the characteristics and analysis of prior art, it can be concluded that the task of providing a device for generating unvarying DC current flowing through a changing load having a wider range of values of the load resistance has been relevant.

SUMMARY OF THE INVENTION

The technical result mentioned above is achieved by providing a device for producing a constant current flowing in a load, the device comprising a DC voltage source; a DCPVC connected by its input to the output of the DC voltage source; a PDCVC connected by its input to the output of the DCPVC; a DC stabilizer; a control circuit, connected by one of its inputs to a first output of the DC stabilizer, and connected by its output to a control input of the PDCVC; and a load, which in the present invention is connected by one of its terminals to an output of the PDCVC and is connected by its another terminal to an input of the DC stabilizer and to another input of the control circuit; whereas the DC stabilizer is connected by its another output to a negative terminal of the DC voltage source.

The above-identified connection of the load and DC stabilizer makes it possible to stabilize the current flowing through the load (further load current) in the process of converting DC voltage into pulse voltage and converting pulse voltage into DC voltage, as well as to generate control voltage which, when applied to a control input of the DCPVC, makes possible to change pulse ratio and thus stabilize a DC stabilizer voltage drop. As this takes place, the maximum load voltage when the load current is stabilized is limited by only accessible voltages for the elements used in the PDCVC and DCPVC. These voltages are large enough, therefore load resistance can vary within wide limits.

Thus, a flow of DC of unvarying value in a broader range of load changes is secured, and this manifests the consummation of the above-identified technical result.

The analysis of the prior art showed that none of them contains both the totality of essential features of the proposed technical solutions and distinctive features thereof, that led to the conclusion of the present device for generating unvarying load current meeting the patentability criteria of "novelty" and "inventive step".

BRIEF DESCRIPTION OF DRAWINGS

The proposed apparatus for producing unvarying load current is explained by the following description and the drawings of FIGS. 1, 2*a*, and 2*b*, where:

FIG. 1 is a block diagram of the apparatus, whereas

DETAILED DESCRIPTION

Figure 1:
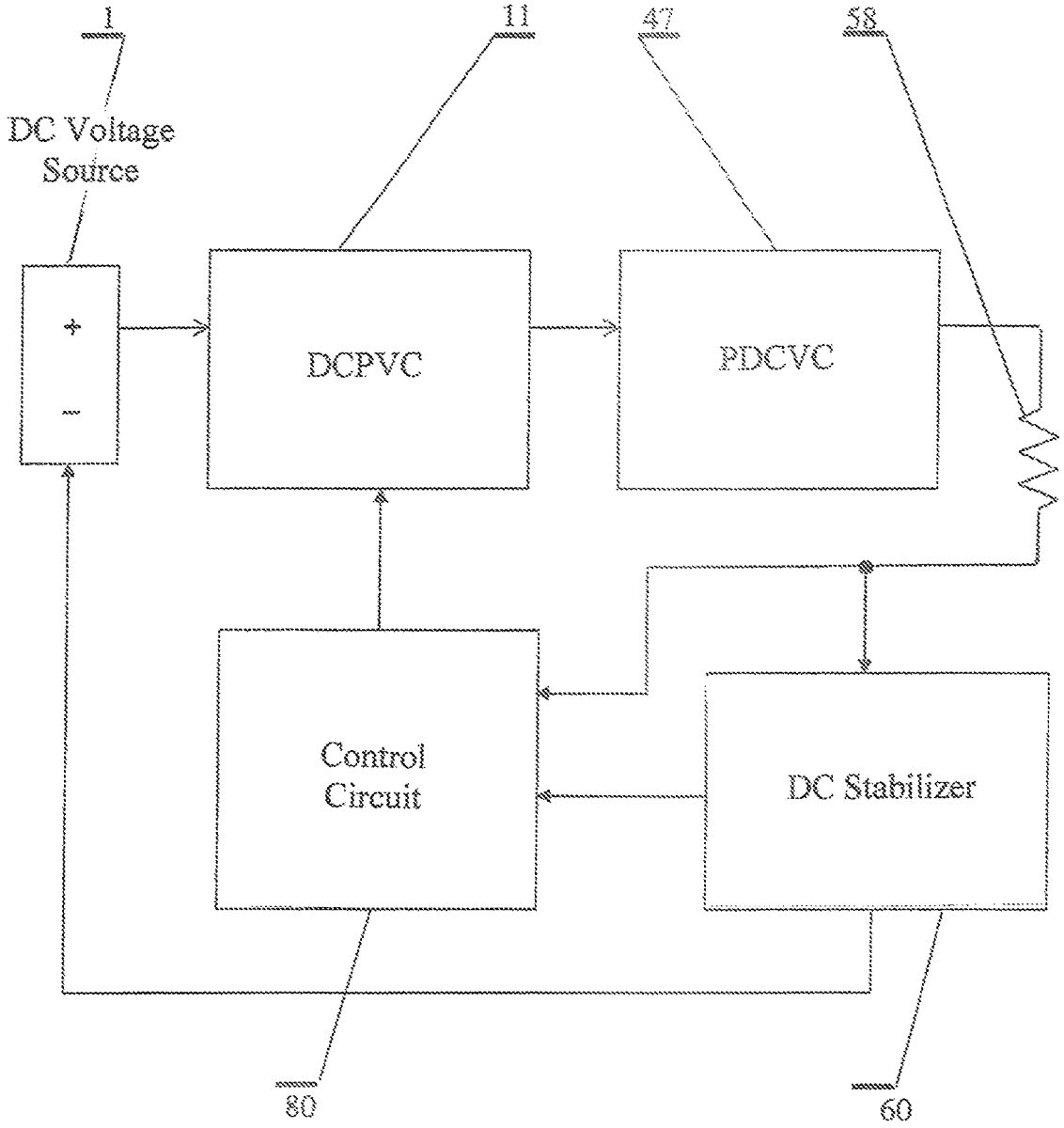
Figure 2A:
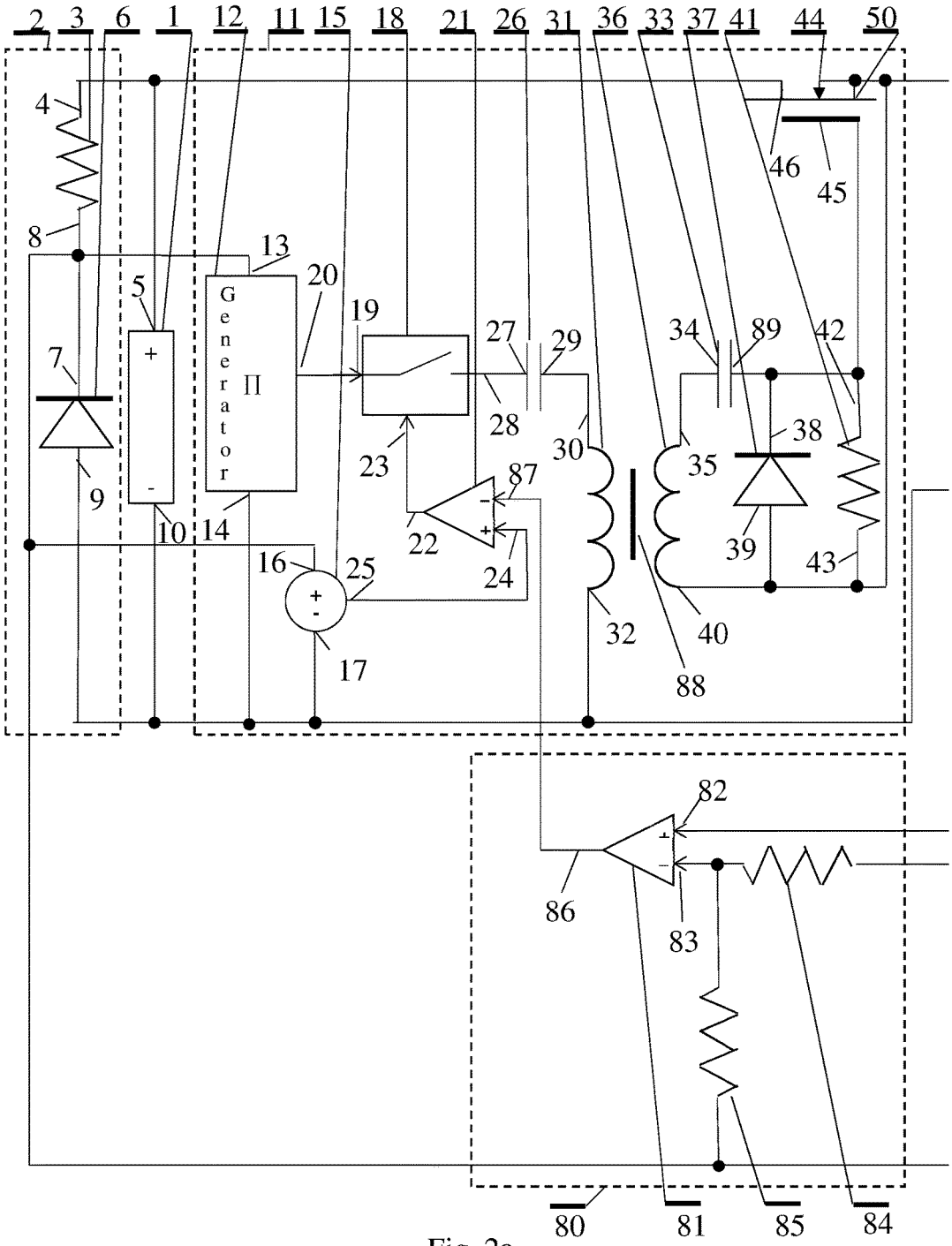
FIGS. 2*a* and 2*b*, to be considered together, constitute a schematic diagram of the apparatus.
Figure 2B:
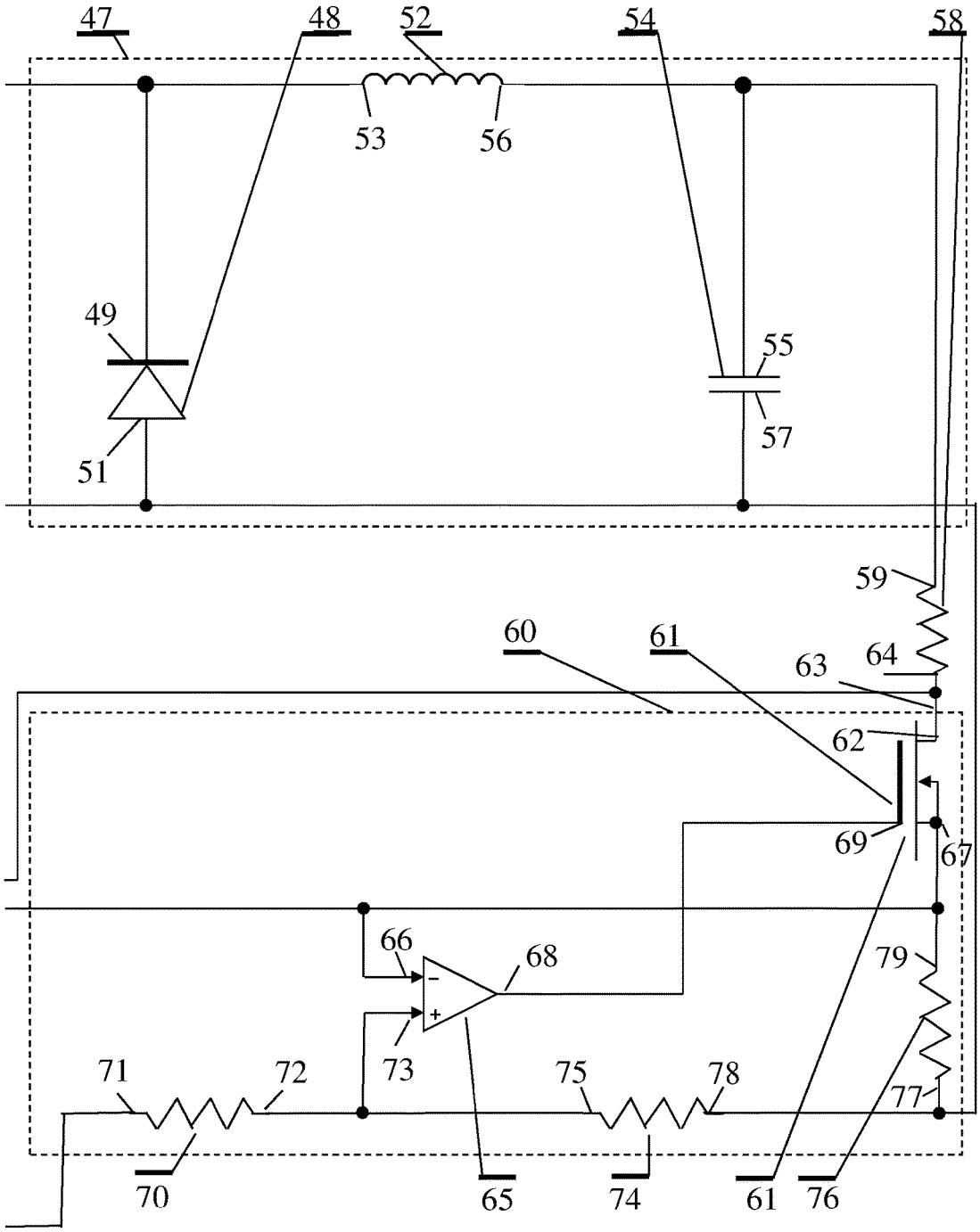

A proposed and discussed below apparatus for producing unvarying direct load current comprises according to FIGS. 1, 2*a*, and 2*b*:

a DC voltage source (1) which is produced by any known method, for example, using a full-wave rectifying circuit with a filter;

an auxiliary DC voltage source (2) including, for example, a resistor (3) which is connected by one of its terminals (4) to a positive terminal (5) of the DC voltage source (1), and a Zener diode (6) which is connected by its cathode (7) to another terminal (8) of the resistor (3) and by its anode (9) to a negative terminal (10) of the DC voltage source (1);

a DC-voltage-to-pulse-voltage converter (DCPVC)(11) comprising, for example:

a generator (12) of rectangular pulses of constant frequency connected by one of its terminals (13) (which is a first input of the DCPVC (11)) to an output of the auxiliary DC voltage source (2) (namely, to the cathode (7) of the Zener diode (6)) and by another its terminal (14) to the negative terminal (10) of the DC voltage source (1), a reference voltage source (15) connected in parallel by its first (16) and second (17) terminals to the terminals (13) and (14) of the generator (12) of rectangular pulses of constant frequency, a controllable switch (18) connected by its input (19) to an output (20) of the generator (12) of rectangular pulses of constant frequency, an operational amplifier (21) connected by its output (22) to a control input (23) of the controllable switch (18) and by its non-inverting ("+") input (24) to an output (25) of the reference voltage source (15), a first capacitor (26) connected by one of its plates (27) to an output (28) of the controllable switch (18) and by its another plate (29) to a first terminal (30) of a primary winding (31) of a transformer (88), a second terminal (32) of the primary winding (31) being connected to the negative terminal (10) of the DC voltage source (1), a second capacitor (33) connected by one its plates (34) to a first terminal (35) of a secondary winding (36) of the transformer (88), a diode (37) connected by its cathode (38) to another plate (89) of the second capacitor (33) and by its anode (39) to a second terminal (40) of the secondary winding (36) of the transformer (88), a resistor (41) connected by one (42) of its terminals to the cathode (38) of the diode (37) and by its another terminal (43) to the anode (39) of the diode (37), a MOS transistor (44) connected by its gate (45) to the cathode (38) of the diode (37), by its drain (46) (which is the second input of the DCPVC (11)) to the positive terminal (5) of the DC voltage source (1), and by its source (50) to the second terminal (40) of the secondary winding (36) of the transformer (88);

a pulse-voltage-to-DC-voltage converter (PDCVC) (47) comprising, for example:

a diode (48) connected by its input (cathode (49)) to the source (50) of the MOS-transistor (44) (output of the DCPVC (11)) and by its anode (51) to the negative terminal (10) of the DC voltage source (1), an inductor (52) connected by one (53) of its terminals to the cathode (49) of the diode (48), a capacitor (54) connected by one (55) of its plates to another terminal (56) of the inductor (52) and by its another plate (57) to the negative terminal (10) of the DC voltage source (1);

a load (58), connected by one (59) of its terminals to an output of the PDCVC (47) (to the other terminal (56) of the inductor (52));

a DC stabilizer (60) comprising, for example:

a MOS transistor (61) connected by its drain (62) (which is a first input (63) of the DC stabilizer (60)) to the terminal (64) the load (58), an operational amplifier (65) connected by its inverting ("−") input (66) to a source (67) (which is a first output of the DC stabilizer (60)) of the MOS transistor (61) and connected by its output (68) to a gate (69) of the MOS transistor (61).

a reference voltage source comprising, for example, a first resistor (70) connected by one (71) of its terminals to the output of the auxiliary DC voltage source (2) (to the cathode (7) the zener diode (6)) and by its another terminal (72) to a non-inverting ("+") input (73) of the operational amplifier (65), and a second resistor (74) connected by one (75) of its terminals to the other terminal (72) of the first resistor (70), a resistor (76) connected by one (77) of its terminals to another terminal (78) of the second resistor (74) of the reference voltage source (a second output of the DC stabilizer (60)), also connected to the negative terminal (10) of the DC voltage source (1), and by its another terminal (79) to the source (67) of the MOS transistor (61);

a control circuit (80) comprising, for example, an operational amplifier (81) connected by its non-inverting ("+") input (82) (which is a first input of the control circuit (80)) to the drain (62) of the MOS transistor (61) (which is the input (63) of the DC stabilizer (60)), by its inverting ("−") input (83) via a first resistor (84) to the source (67) of the MOS transistor (61) (which is a second input of the control circuit (80)), and through a second resistor (85) to the output of the auxiliary DC voltage source (2) (to the cathode (7) of the Zener diode (6)), and by its output (86) to the inverting ("−") input (87) of the operational amplifier (21) of the DCPVC (11) which is a control input of the DCPVC (11).

The proposed device for producing an unvarying direct load current operates as follows.

At applying DC voltage from the terminals (5) and (10) of the DC voltage source (1) to the inputs (4) and (9) of the auxiliary DC voltage source (2) and to the inputs (46) and (17) of the DCPVC (11), the generator (12) of rectangular pulses of constant frequency in the DCPVC (11) starts to generate pulses that come from the output (20) of the generator (12) of rectangular pulses of constant frequency to the data port (19) of the controllable switch (18) of the DCPVC (11). As long as the voltage at the inverting ("−") input (87) of the operational amplifier (21) is less than the voltage at the non-inverting ("+") input (24) of the operational amplifier (21), which is determined by the voltage at the output (25) of the reference voltage source (15), the voltage at the output (22) of the operational amplifier (21) will keep the controllable switch (18) closed. At that, the pulses from the output (20) of the generator (12) of rectangular pulses of constant frequency will, through the controllable switch (18), arrive to the gate (45) of the MOS transistor (44) in the circuit: the first capacitor (26), the primary winding (31) and the secondary winding (36) of the transformer (88)—the second capacitor (33) and connected in parallel the diode (37) and the resistor (41). As a result, the MOS transistor (44) converts a DC voltage from the DC voltage source (1) into a pulse voltage, and these pulses come from the source (50) of the MOS transistor (44) to the terminal (53) of the inductor (52), which is the input of the PDCVC (47). After the conversion and filtering by a LC-filter (the inductor (52) and capacitor (54)), a DC voltage starts rising at the output (56) of the inductor 52. The resulting DC voltage is applied from the output (56) of the PDCVC (47) through the load (58) to the input (63) of the DC stabilizer (60) (to the drain (62) of the MOS transistor (61)).

Through the use of the DC stabilizer (60), comprising for example, the operational amplifier (65), MOS transistor (61) and reference voltage source comprising the first and second resistors (70) and (74) connected in series, the voltage across the resistor (76) of the DC stabilizer (60) becomes stabilized.

As a result of stabilizing voltage across the resistor (76) of the DC stabilizer (60), a current will flow through the resistor (76) in the circuit: the source (67) of the MOS transistor (61), —the negative terminal (10) of the DC voltage source (1), the current depending neither from the voltage at the input (63) of the DC stabilizer (60) nor from the load (58), the amperage of the current being defined by the rating of the resistor (76) and the value of the voltage at the non-inverting ("+") input (73) of the operational amplifier (65) of the DC stabilizer (60). In this case, if the voltage at the non-inverting ("+") input (73) of the operational amplifier (65) of the DC stabilizer (60) (which is determined by the voltage at the midpoint (the terminal (72) of the resistor (70)) of the voltage divider formed by the resistors (70) and (74)) is greater than the voltage at the inverting ("−") input (66) of the operational amplifier (65) connected to the source (67) of the MOS transistor (61) and resistor (76) of the DC stabilizer (60), then the voltage at the output (68) of the operational amplifier (65) connected to the gate (69) of the MOS transistor (61) will be of such value that the MOS transistor (61) opens and the voltage across the resistor (76) will increase as long as it becomes equal to the value of the voltage at the midpoint (the terminal (72) of the resistor (70)) of the voltage divider formed by the resistors (70) and (74).

At this point, the voltage at the output (68) of the operational amplifier (65) and, respectively, at the source (67) of the MOS transistor (61) will stop rising and will be of the value at which the voltage at a connection of the source (67) of the MOS transistor (61) and the resistor (76) becomes equal to the voltage at the non-inverting ("+") input (73) of the operational amplifier (65). The magnitude of that voltage is equal to the voltage at the midpoint (the terminal (72) of the resistor (70)) of the voltage divider formed by the resistors (70) and (74). This state will be maintained at the variations of a voltage at the input (63) of the DC stabilizer (60) and of the load (58). Therefore, if the magnitude of the load (58) changes, the unvarying stabilized DC current, whose value is determined by the value of the voltage supplied from the point of connection of the first resistor (70) and the second resistor (74), and the value of the resistor (76), will flow in the load (58).

As the voltage at the input (63) of the DC stabilizer (60) rises, the DC voltage at the drain-source of the MOS transistor (61) of the DC stabilizer (60) will also increase, so the increase of the DC voltage at the drain-source of the MOS transistor (61) has to be stabilized. For that, voltage from the drain (62) of the MOS transistor (61) (and from the terminal (64) of the load (58)) is applied to the non-inverting ("+") input (82) of the operational amplifier (81) of the control circuit (80), and voltage from the source (67) of the MOS transistor (61) of the DC stabilizer (60) via the first resistor (84), as well as voltage from the cathode (7) of the Zener diode (6) of the auxiliary DC source (2) via the second resistor (85) are applied to the inverting ("−") input (83) of the operational amplifier (81) of the control circuit (80).

Upon comparing the voltages at the non-inverting ("+") input (82) and inverting ("−") input (83) of the operational amplifier (81) of the control circuit (80), voltage is formed at the output (86) of the operational amplifier (81) of the control circuit (80) which is applied to the inverting ("−") input (87) of the operational amplifier (21) of the DCPVC (11), which is a control input of the DCPVC (11).

And as long as the voltage at the non-inverting ("+") input (82) of the operational amplifier (81) of the control circuit (80) is less than the voltage at the inverting ("−") input (83) of the operational amplifier (81) of the control circuit, the output voltage at the output (86) of the operational amplifier (81) is low. As a result, the voltage at the inverting ("−") input (87) of the operational amplifier (21) of the DCPVC (11) is less than the voltage at the non-inverting ("+") input (24) of the operational amplifier (21) which is connected to the output (25) of the reference voltage source (15). Therefore, the output voltage at the output (22) of the operational amplifier (21) is of such value that the controllable switch (18) of the DCPVC (11) is closed, and the pulses from the generator (12) of rectangular pulses of constant frequency of the DCPVC (11) via the controllable switch (18) will pass in the circuit comprising the first capacitor (26), the windings (31) and (36) of the transformer (88), and the second capacitor (33) to the diode (37) and resistor (41) connected in parallel to each other, and further to the gate (45) and source (50) of the MOS transistor (44). At that, there will be pulses at the input (53) of the PDCVC (47) is a pulsed dc voltage is a pulse voltage, which, after conversion and filtering in the PDCVC (47) will cause the increase of the output voltage of the PDCVC.

This process will take its course until the voltage at the drain (62) of the MOS transistor (61) of the DC stabilizer (60) relative to the source (67) becomes slightly greater than the voltage across the resistor (84) of the control circuit (80). As soon as this happens, the voltage at the non-inverting ("+") input (82) of the operational amplifier (81) of the control circuit (80) becomes greater than the voltage at the inverting ("−") input (83) of the operational amplifier (81) of the control circuit (80). Therefore, the output voltage at the output (86) connected to the control input (87) of the DCPVC (11) will be of such value that the voltage at the inverting ("−") input (87) of the operational amplifier (21) of the DCPVC (11) will rise and become greater than the voltage at the non-inverting ("+") input (24) of the operational amplifier (21) of the DCPVC (11).

As a result, the voltage at the output (22) of operational amplifier (21) of the DCPVC (11) will be of such value that the controllable switch (18) will open, and the pulses from the generator (12) of rectangular pulses of constant frequency will no longer pass to the gate (45)—source (50) of the MOS transistor (44) of the DCPVC (11).

As this takes place, the voltage at the output (56) of the PDCVC (47) (as well as at the drain (62) of the MOS transistor (61) of the DC stabilizer (60)) stops increasing and starts decreasing. For this reason, the voltage at the inverting ("−") input (87) of the operational amplifier (21) will again become less than the voltage at the non-inverting ("+") input (24) of the operational amplifier (21) of the DCPVC (11).

That is, the operational amplifier (21) of the DCPVC (11) compares the voltage of the reference voltage source (15) with the voltage from the output (86) of the operational amplifier (81) of the control circuit (80) and creates on its output (22) a control voltage which is applied to the control input (23) of the controllable switch (18) closing or opening its contacts and thereby altering the duty cycle of the pulses fed to the gate (45)—source (50) of the MOS transistor (44).

These pulses with the changed duty cycle come from the output (50) of the DCPVC (11) to the input (53) of the PDCVC (47), and, after the appropriate converting and LC-filtering (by the inductor (53) and capacitor (54)), DC voltage at the output (56) of the PDCVC (47) starts to grow again, and the entire process will be repeated.

Thus, the voltage at the drain-source of the MOS transistor (61) of the DC stabilizer (60) will be equal to the value of voltage across the resistor (84) of the control circuit (80) with small voltage ripple, whereas the current flowing in the load (58) will not be affected by changes of the load (58), both increasingly and decreasingly.

It should be particularly noted that the load (58) in the proposed technical solution is connected by one of terminals (59) to the output (56) of the PDCVC (47) and by the other terminal (64) to the input (63) of the DC stabilizer (60) and to the other input (82) of the control circuit (80). Therefore, the maximum output voltage at the load (58) with the stabilized load current is limited only by the maximum allowed voltage for the elements used in the PDCVC (47) and the DCPVC (11), which can be as high as hundreds volts and more.

Thus, the resistance of the load (58) with the stabilized load current in the present invention may vary within wide limits.

The lower limit of the load resistance-zero (a short-circuit mode), the apparatus continues to operate with that, and the DC current, whose value is determined by the voltage at the midpoint of the voltage divider formed by the resistors (70) and (74), and the value of the resistor (76) of the DC stabilizer (60), flows from the output (56) of the PDCVC (47) through the DC stabilizer (60).

The upper limit of the load resistance is determined by the ratio of the maximum allowed voltages for the elements used in the PDCVC (47) and the elements used in the DCPVC (11) (and the DC voltage source (1)), which can be high enough, and the current flowing through the DC stabilizer (60).

Thus, the proposed device for obtaining a direct current flowing in the load provides an unvarying value of the direct current flowing through the load that can change in a wider range.

The invention claimed is:

1. An apparatus for producing unvarying direct load current, the apparatus comprising a DC voltage source, a DC-voltage-to-pulse-voltage converter connected by an input thereof to an output of the DC voltage source, a pulse-voltage-to-DC-voltage converter connected by an input thereof to an output of the DC-voltage-to-pulse-voltage converter, a DC stabilizer, a control circuit directly connected in series by a second input of inputs thereof to a first output of the DC stabilizer and by an output thereof to a control input of the DC-voltage-to-pulse-voltage converter, and a load, wherein the load is connected by one of terminals thereof to an output of the pulse-voltage-to-DC-voltage converter and by another terminal thereof to a first input of the control circuit and to an input of the DC stabilizer connected by a second output thereof to the DC voltage source, wherein the DC stabilizer comprises a first operational amplifier, a MOS transistor and a reference voltage source, the MOS transistor being connected to the input of the DC stabilizer, to an output of the first operational amplifier, and to the first output of the DC stabilizer, and inputs of the first operational amplifier being connected to the MOS transistor and to the reference voltage source connected to the second output of the DC stabilizer, and wherein the control circuit comprises a second operational amplifier, and a first and a second resistors, a non-inverting ("+") input of the second operational amplifier being connected to the first input of the control circuit, an inverting ("−") input of the second operational amplifier being connected via the first resistor to the second input of the control circuit and being connected via the second resistor to the reference voltage source, an output of the second operational amplifier being connected to the output of the control circuit.

* * * * *